United States Patent [19]

Mandarano et al.

[11] Patent Number: 4,647,510

[45] Date of Patent: Mar. 3, 1987

[54] WEIGHT WATCHERS NOVELTY ITEM

[76] Inventors: Anthony L. Mandarano; Frank Mandarano, both of 37 Roseneath Gardens; Donna Sistelli, 48 Roseneath Gardens, all of Toronto, Ontario, Canada, M6C 3X5

[21] Appl. No.: 673,504

[22] Filed: Nov. 20, 1984

[51] Int. Cl.[4] ..... A63H 3/38

[52] U.S. Cl. ..... 428/542.2; 272/8 N; 434/127; 446/392

[58] Field of Search ..... 428/16, 24, 64, 900, 428/542.2; 272/8 N; 446/325, 389, 392; 434/127

[56] References Cited

U.S. PATENT DOCUMENTS

| | | | |
|---|---|---|---|
| D. 268,530 | 4/1983 | Ament | D21/148 X |
| 2,903,816 | 9/1959 | Fox | 272/8 N X |
| 3,827,020 | 7/1974 | Okamoto | 428/900 X |
| 3,841,019 | 10/1974 | Lorenzo | 428/16 X |
| 3,959,060 | 5/1976 | Jones | 428/16 X |
| 4,222,179 | 9/1980 | Goody | 428/24 X |
| 4,237,634 | 12/1980 | Pokhis | 446/392 X |

*Primary Examiner*—Henry F. Epstein

[57] ABSTRACT

The present invention provides a novelty for use as a psychological overeating deterent. The novelty comprises a weight member provided with eye forming portions for simulating eye contact with movement of the novelty which is in effect a weight watching weight.

3 Claims, 2 Drawing Figures

WEIGHT WATCHERS NOVELTY ITEM

FIELD OF THE INVENTION

The present invention provides a novelty item for encouraging exercising and for detering over eating.

BACKGROUND OF THE INVENTION

As is well evidenced by today's society, many people are subject to over eating and under exercising however, in many cases only a small reminder is required to alleviate both situations, particularly when the reminder is something that is cute and attractive without being too personal.

SUMMARY OF THE PRESENT INVENTION

The present invention provides a novelty for use as a pyschological overeating and under exercising deterent. The novelty comprises a weight member having a pair of side by side transparent eye socket forming shells on a face of the weight member and a pair of eye forming members, one in each shell. These eye forming members are free within the shells for simulating eye contact with the eye forming members upon movement of the novelty. Accordingly the novelty has the effect of being a reminder for a person to watch his or her weight without hurting the feelings of that person.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS

Figure 1:
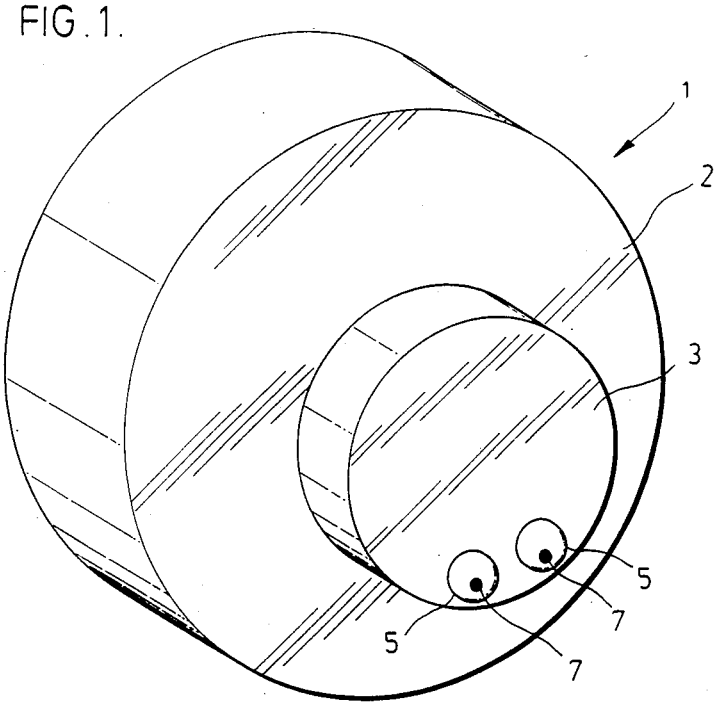
FIG. 1 is a top perspective view of a novelty according to a preferred embodiment of the present invention.
Figure 2:
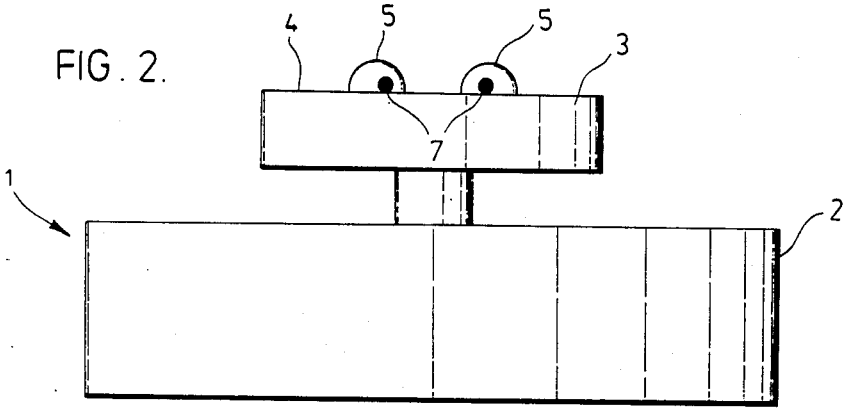
FIG. 2 is a side view of the novelty shown in FIG. 1.

The novelty item shown in the drawings makes use of a standard measurement weight, generally indicated at 1. This measurement weight will preferably be something portable and small in the neighbourhood, for example, a few hundred grams so that it is easily carried about in ones pocket.

The measurement weight has a bottom portion 2 and an upper portion 3 provided with a top surface or face 4. Mounted on this top face of the measurement weight are a pair of transparent bulbous shells 5. Sealed within each of the shells is a small rounded member 7.

As will be seen in FIG. 1, the two shells are located side by side on the top surface 4 of the weight. This mounting in combination with the shaping of the upper portion of the weight gives a facial appearance to the novelty item with the shells forming eye sockets and the small rounded members 7, forming eyes within the sockets. To add to this the members 7 are free to roll within the shells simulating constant eye contact with the eyes when the novelty item is moved. Accordingly the concept of the novelty item is that it is a weight that is constantly watching your weight.

Although various preferred embodiments of the present invention have been described herein in detail it will be appreciated by those skilled in the art that variations may be made thereto without departing from the spirit of the invention or the scope of the appended claims.

The embodiments of the invention in which an exclusive property or privilege is claimed are defined as follows:

1. A psychological over-eating and under-exercising deterrent, comprising a standard measuring weight, having an enlarged base portion and a smaller upper portion with an upper face having a pair of side-by-side, transparent eye socket forming shells thereon, and a pair of eye forming members, one at each shell, said eye forming members being free within said shells for simulating eye contact with the eye upon movement of the novelty item and a short cylindrical portion extending from said base portion to the upper portion.

2. A novelty item as claimed in claim 1, wherein said eye forming members are rounded for rolling within said shells.

3. A novelty item as claimed in claim 2 wherein said shells are bulbous in configuration.

* * * * *